US011946003B2

(12) United States Patent
Guo et al.

(10) Patent No.: US 11,946,003 B2
(45) Date of Patent: Apr. 2, 2024

(54) SYSTEM AND METHOD FOR PRODUCING NEEDLE COKE

(71) Applicants: CHINA PETROLEUM & CHEMICAL CORPORATION, Beijing (CN); SINOPEC DALIAN RESEARCH INSTITUTE OF PETROLEUM AND PETROCHEMICALS CO., LTD., Liaoning (CN)

(72) Inventors: Dan Guo, Liaoning (CN); Xiangchen Fang, Liaoning (CN); Kai Qiao, Liaoning (CN); Renqing Chu, Liaoning (CN); Lianzhong Gou, Liaoning (CN); Tianzuo Chen, Liaoning (CN)

(73) Assignees: CHINA PETROLEUM & CHEMICAL CORPORATION, Beijing (CN); SINOPEC DALIAN RESEARCH INSTITUTE OF PETROLEUM AND PETROCHEMICALS.CO., LTD., Liaoning (CN)

( * ) Notice: Subject to any disclaimer, the term of this patent is extended or adjusted under 35 U.S.C. 154(b) by 55 days.

(21) Appl. No.: 17/758,262

(22) PCT Filed: Dec. 3, 2020

(86) PCT No.: PCT/CN2020/133569

§ 371 (c)(1),
(2) Date: Jun. 30, 2022

(87) PCT Pub. No.: WO2021/135802

PCT Pub. Date: Jul. 8, 2021

(65) Prior Publication Data

US 2023/0038156 A1 Feb. 9, 2023

(30) Foreign Application Priority Data

Dec. 31, 2019 (CN) ..... 201911423745.8

(51) Int. Cl.
*C10G 69/06* (2006.01)
*C10B 41/00* (2006.01)
(Continued)

(52) U.S. Cl.
CPC ..... *C10G 69/06* (2013.01); *C10B 41/00* (2013.01); *C10B 55/00* (2013.01); *C10G 9/005* (2013.01); *C10G 2300/4012* (2013.01)

(58) Field of Classification Search
CPC ..... C10G 9/005; C10G 69/06; C10B 41/00; C10B 41/08; C10B 55/00
See application file for complete search history.

(56) References Cited

U.S. PATENT DOCUMENTS

| | | | |
|---|---|---|---|
| 4,940,529 | A | 7/1990 | Beaton et al. |
| 6,764,592 | B1 | 7/2004 | Ganji |
| 10,611,971 | B2 | 4/2020 | Banerjee |

FOREIGN PATENT DOCUMENTS

| | | | |
|---|---|---|---|
| CN | 103184057 | A | 7/2013 |
| CN | 104046384 | A | 9/2014 |

(Continued)

OTHER PUBLICATIONS

English machine translation for CN 105542846 (Year: 2016).*
English machine translation for CN 104560152 (Year: 2015).*
English machine translation for CN 104449829 (Year: 2015).*

*Primary Examiner* — Renee Robinson
(74) *Attorney, Agent, or Firm* — NKL Law; Allen Xue

(57) ABSTRACT

A system for producing needle coke and a method for producing needle coke using the system are provided. The system includes a coke tower, a pressure stabilization tower, a buffer tank and a coking fractionation tower. A pressure (Continued)

controller is provided at the top of the pressure stabilization tower for adjusting the pressure at the top thereof. An oil gas outlet of the coke tower is in communication with an oil gas inlet of the pressure stabilization tower through a pipeline. No pressure controller for adjusting the pressure at the top of the coke tower is provided in the coke tower or on the oil gas pipeline connecting the coke tower to the pressure stabilization tower.

21 Claims, 3 Drawing Sheets

(51) Int. Cl.
*C10B 55/00* (2006.01)
*C10G 9/00* (2006.01)

(56) References Cited

FOREIGN PATENT DOCUMENTS

| | | | | | |
|---|---|---|---|---|---|
| CN | 104449829 | | * | 3/2015 | ..... C10G 55/04 |
| CN | 104560152 | A | | 4/2015 | |
| CN | 104974782 | A | | 10/2015 | |
| CN | 105542846 | A | | 5/2016 | |

* cited by examiner

SYSTEM AND METHOD FOR PRODUCING NEEDLE COKE

CROSS REFERENCE TO RELATED APPLICATIONS

This application is a U.S. national stage entry of PCT international application no. PCT/CN2020/133569, filed on Dec. 3, 2020, which claims priority from Chinese patent application No. 201911423745.8, filed on Dec. 31, 2019, titled "a method and system for improving the stability of a needle coke production process," the content of which is incorporated herein by reference in its entirety.

TECHNICAL FIELD

The present application relates to the field of needle coke production, and particularly to a system and method for producing needle coke with improved stability.

BACKGROUND ART

The production of needle coke is typically carried out by delayed coking process, but the formation of needle coke follows the liquid phase carbonization theory and a temperature-changing operation is adopted in the production process, which is different from the conventional delayed coking process.

CN103184057A discloses a method for producing needle coke by temperature-changing operation, in which the temperature in a coke tower is controlled and maintained at 390-510° C. by controlling the outlet temperature of a coking furnace. In a first reaction stage, the temperature in the coke tower is 390-460° C., and intermediate phase liquid crystal is formed in the system; in a second reaction stage, the temperature in the coke tower is raised to 450-480° C., and the intermediate phase liquid crystal begins to solidify; and in a third reaction stage, the temperature in the coke tower is raised to 460-510° C. and the intermediate phase liquid crystal is fully solidified to form needle coke.

CN104560152A discloses a method for producing needle coke by temperature- and pressure-changing operation, in which the outlet temperature of a coking furnace is controlled within a range of 430-520° C., and the pressure of a coke tower is controlled within a range of 0.1-3.0 MPa. In a first reaction stage, the outlet temperature of the furnace is raised from a low temperature to 480° C., and the pressure of the coke tower is kept at 1.5 MPa; in a second reaction stage, the outlet temperature of the furnace is continuously raised, the pressure of the coke tower is gradually reduced to 0.5 MPa and then kept constant, and needle coke is formed.

Due to the temperature- and pressure-changing characteristics of the production process of needle coke, the industrial production of needle coke is very difficult, and the device operation is unstable. In the initial reaction stage, a feedstock is fed to the coke tower at a lower temperature, a mild reaction occurs, a relatively lower amount of oil gas is produced, and liquid amount in the coke tower is continuously increased; as the reaction progresses, the temperature of the furnace is gradually raised, the temperature in the coke tower is gradually increased to the coking temperature, violent thermal cracking and thermal polycondensation reactions occur, and a large amount of oil gas is discharged to a fractionation system; at the end of the reaction, the materials in the coke tower are substantially solidified to form needle coke, and the amount of oil gas generated is reduced. In the whole reaction period, the fluctuation in the amount of oil gas discharged at the top of the coke tower is large, the adjustment range of the pressure control system at the top of the coke tower is wide, and the pressure control system cannot be always maintained in a proper operation range; moreover, the throughput of the fractionation unit fluctuates greatly, and consequently the separation effect is poor, and the operation stability is affected.

SUMMARY OF THE INVENTION

Directing to the defects of the prior arts, the present application provides a novel system and method for producing needle coke, by which the stability of the needle coke production process can be improved, and, in the whole reaction period, the coking fractionation unit shows a small fluctuation in the throughput and a high separation precision, and it is easy to control the pressure of the coke tower, so that the operation stability of the whole system is greatly improved.

In an aspect, the present application provides a system for producing needle coke, comprising:

a coke tower provided with a feedstock inlet and an oil gas outlet, where a hydrocarbon-containing feedstock is reacted to produce needle coke and oil gas;

a pressure stabilization tower provided with an oil gas inlet, an overhead light fraction outlet, a bottom oil outlet and a cycle oil inlet, where the oil gas from the coke tower is received and separated into an overhead light fraction and a bottom oil, and a pressure controller is provided at the top of the pressure stabilization tower for adjusting the pressure at the top thereof;

a buffer tank provided with an inlet, a first bottom oil outlet, and a second bottom oil outlet, for receiving the bottom oil from the pressure stabilization tower and providing a buffering action; and a coking fractionation tower provided with an inlet, a light oil outlet and a heavy oil outlet, where the bottom oil from the buffer tank is received and separated into a light oil and a heavy oil;

wherein the oil gas outlet of the coke tower is in communication with the oil gas inlet of the pressure stabilization tower through a pipeline, and no pressure controller for adjusting the pressure at the top of the coke tower is provided in the coke tower or on the oil gas pipeline connecting the coke tower to the pressure stabilization tower, the inlet of the buffer tank is in communication with the bottom oil outlet of the pressure stabilization tower, the first bottom oil outlet of the buffer tank is in communication with the cycle oil inlet of the pressure stabilization tower through a pipeline with a temperature adjuster provided thereon, and the second bottom oil outlet of the buffer tank is in communication with the inlet of the coking fractionation tower, and optionally, the heavy oil outlet of the coking fractionation tower is in communication with the feedstock inlet of the coke tower.

In another aspect, the present application provides a method for producing needle coke using the system of the present application, comprising the steps of:

(1) reacting a heated hydrocarbon-containing feedstock in the coke tower to obtain needle coke and an oil gas;

(2) separating the oil gas from the coke tower in the pressure stabilization tower to obtain an overhead light fraction and a bottom oil;

(3) sending the bottom oil from the pressure stabilization tower to the buffer tank, and withdrawing two streams of bottom oil from the buffer tank;

(4) returning a first stream of bottom oil from the buffer tank to the pressure stabilization tower after a temperature adjustment;

(5) sending a second stream of bottom oil from the buffer tank to the coking fractionation tower, separating the stream into a light oil and a heavy oil therein, and optionally returning the heavy oil to the coke tower for further reaction, wherein the pressure at the top of the pressure stabilization tower is adjusted by the pressure controller at the top of the pressure stabilization tower, so that the pressure at the top of the coke tower is maintained at a set value.

Compared with prior arts, the system and method for producing needle coke have the following advantages:

(1) in the whole needle coke production period, the fluctuation of the oil gas discharge rate of the coke tower is large, the pressure of the coke tower is adjusted by a pressure controller at the top of the coke tower in the prior art, and the operating range of the pressure controller is wide, so that the operation of the reaction system shows a large fluctuation and is unstable. In the present application, a pressure stabilization tower is provided downstream the coke tower and a pressure controller is provided at the top of the pressure stabilization tower, and because the oil gas outlet at the top of the coke tower is in communication with the oil gas inlet of the pressure stabilization tower, and no pressure controller is provided in the coke tower or on the oil gas pipeline connecting the coke tower to the pressure stabilization tower, the pressure at the top of the coke tower and the pressure at the top of the pressure stabilization tower are closely interrelated, so that the pressure at the top of the coke tower can be controlled through adjusting the pressure at the top of the pressure stabilization tower. Meanwhile, compared with the amount of oil gas discharged from the top of the coke tower, the amount of the light fraction discharged from the top of the pressure stabilization tower is much smaller, so that the operation range of the pressure controller is greatly reduced, and the pressure controller can be stably maintained within the optimal operation range, which is favorable to a stable control of the pressure at the top of the coke tower.

(2) a part of the oil gas from the coke tower can be condensed in the pressure stabilization tower provided in the present application, so that the flow rate of the overhead light fraction of the pressure stabilization tower is less than the oil gas flow rate at the top of the coke tower, and where the pressure at the top of the pressure stabilization tower is controlled through the flow rate of the overhead component, the switch range of the flow control valve is relatively small, so that the fluctuation of the pressure in the system can be reduced. In addition, the amount of oil gas produced changes continuously during the needle coke production process, and thus the pressure control valve has to be continually adjusted to maintain the pressure in the tower. Where the pressure control valve is provided at the top of the coke tower, a great change in the opening of the valve may be needed, the temperature of oil gas at the top of the coke tower may reach 420° C. or more, and coking may easily occur. Where the pressure control valve is provided at the top of the pressure stabilization tower, only a small change in the opening of the valve is needed, the temperature of the light fraction is relatively low, and the coking tendency is reduced, so that the overall operation stability of the device can be improved, and the running period of the device can be prolonged.

(3) in the system and method of the present application, the liquid level of the pressure stabilization tower is adjusted and its operation temperature is ensured to fluctuate within a reasonable range through the cooperation operation of the pressure stabilization tower and the buffer tank and the recycling of the temperature-adjusted bottom oil, so that the pressure at the top of the pressure stabilization tower is ensured to be maintained at a set value.

(4) compared with the prior arts in which the oil gas discharged from the top of the coke tower is directly sent to the coking fractionation tower, by withdrawing a bottom oil from the buffer tank to the coking fractionation tower in the present application, the fluctuation in the operation of the fractionation tower can be greatly reduced, and the separation precision can be improved. On one hand, in the whole production period, the bottom oil can be sent to the fractionation tower at a certain flow rate in view of the need, so that the adverse effect on the operation of the fractionation tower caused by the unstability in the feed rate can be eliminated; on the other hand, non-condensable gas and a part of the light liquid in the oil gas are removed from the bottom oil, so that the fluctuation in the property of the feed to the fractionation tower is reduced.

DETAILED DESCRIPTION OF THE INVENTION

Figure 1:
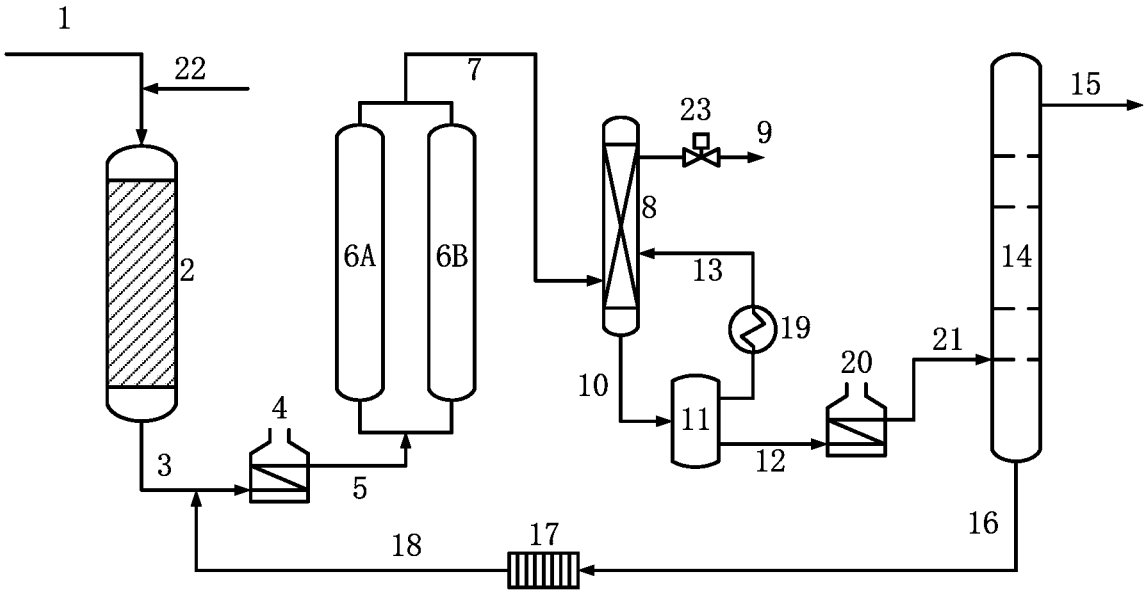
FIG. 1 is a schematic diagram of a preferred embodiment of the system and method for producing needle coke of the present application.

The present application will be further described hereinafter in detail with reference to specific embodiments thereof and the accompanying drawings. It should be noted that the specific embodiments of the present application are provided for illustration purpose only, and are not intended to be limiting in any manner.

Any specific numerical value, including the endpoints of a numerical range, described in the context of the present application is not restricted to the exact value thereof, but should be interpreted to further encompass all values close to said exact value, for example all values within ±5% of said exact value. Moreover, regarding any numerical range described herein, arbitrary combinations can be made between the endpoints of the range, between each endpoint and any specific value within the range, or between any two specific values within the range, to provide one or more new numerical range(s), where said new numerical range(s) should also be deemed to have been specifically described in the present application.

Unless otherwise stated, the terms used herein have the same meaning as commonly understood by those skilled in the art; and if the terms are defined herein and their definitions are different from the ordinary understanding in the art, the definition provided herein shall prevail.

In the context of the present application, the term "coke tower" refers to a reaction equipment for producing needle coke from a hydrocarbon-containing feedstock via a coking reaction, which may be in any form commonly used in the art, to which there is no particular limitation in the present application.

In the context of the present application, the term "coking fractionation tower" refers to an equipment for separating the oil gas generated during coking reaction by fractional distillation, which may be in any form commonly used in the art, to which there is no particular limitation in the present application.

In the context of the present application, the term "light oil" refers to a component with a relatively lower boiling point obtained from the top of the coking fractionation tower, and the term "heavy oil" refers to a component with a relatively higher boiling point obtained from the bottom of the coking fractionation tower, and the cut point between the light oil and the heavy oil can be selected according to the actual need. Typically, the 95% distillate temperature of the "light oil" is about 300-400° C., preferably about 320-360° C., and the 5% distillate temperature of the "heavy oil" is controlled to be higher than the 95% distillate temperature of the "light oil" by about 3° C. or more.

In the context of the present application, in addition to those matters explicitly stated, any matter or matters not mentioned are considered to be the same as those known in the art without any change. Moreover, any of the embodiments described herein can be freely combined with another one or more embodiments described herein, and the technical solutions or ideas thus obtained are considered as part of the original disclosure or original description of the present application, and should not be considered to be a new matter that has not been disclosed or anticipated herein, unless it is clear to those skilled in the art that such a combination is obviously unreasonable.

All of the patent and non-patent documents cited herein, including but not limited to textbooks and journal articles, are hereby incorporated by reference in their entireties.

In a first aspect, the present application provides a system for producing needle coke, comprising:

a coke tower provided with a feedstock inlet and an oil gas outlet, where a hydrocarbon-containing feedstock is reacted to produce needle coke and oil gas;

a pressure stabilization tower provided with an oil gas inlet, an overhead light fraction outlet, a bottom oil outlet and a cycle oil inlet, where the oil gas from the coke tower is received and separated into an overhead light fraction and a bottom oil, and a pressure controller is provided at the top of the pressure stabilization tower for adjusting the pressure at the top thereof;

a buffer tank provided with an inlet, a first bottom oil outlet, and a second bottom oil outlet, for receiving the bottom oil from the pressure stabilization tower and providing a buffering action; and a coking fractionation tower provided with an inlet, a light oil outlet and a heavy oil outlet, where the bottom oil from the buffer tank is received and separated into a light oil and a heavy oil, wherein the oil gas outlet of the coke tower is in communication with the oil gas inlet of the pressure stabilization tower through a pipeline, and no pressure controller for adjusting the pressure at the top of the coke tower is provided in the coke tower or on the oil gas pipeline connecting the coke tower to the pressure stabilization tower, the inlet of the buffer tank is in communication with the bottom oil outlet of the pressure stabilization tower, the first bottom oil outlet of the buffer tank is in communication with the cycle oil inlet of the pressure stabilization tower through a pipeline with a temperature adjuster provided thereon, and the second bottom oil outlet of the buffer tank is in communication with the inlet of the coking fractionation tower, and optionally, the heavy oil outlet of the coking fractionation tower is in communication with the feedstock inlet of the coke tower.

In the system of the present application, because the oil gas outlet at the top of the coke tower is in communication with the oil gas inlet of the pressure stabilization tower, and no pressure controller is provided in the coke tower or on the oil gas pipeline connecting the coke tower to the pressure stabilization tower, the pressure at the top of the coke tower and the pressure at the top of the pressure stabilization tower are closely interrelated, so that the pressure at the top of the coke tower can be controlled through adjusting the pressure at the top of the pressure stabilization tower.

According to the present application, the pressure stabilization tower may be any equipment suitable for receiving the oil gas from the coke tower and separating it into an overhead light fraction and a bottom oil, including, but not limited to, trayed columns, packed columns, and the like, that are commonly used in the field of distillation, to which there is no particular limitation in the present application.

According to the present application, the pressure controller provided at the top of the pressure stabilization tower is a general equipment commonly used in the coking field, to which there is no particular limitation in the present application, as long as it can effectively regulate the pressure at the top of the pressure stabilization tower. In a preferred embodiment, the pressure controller at the top of the pressure stabilization tower may regulate the pressure at the top of the pressure stabilization tower by adjusting the flow rate of the light fraction discharged at the top of the pressure stabilization tower, for example, by adjusting the opening of a valve on the light fraction discharge pipeline, and in turn maintain the pressure at the top of the coke tower at a set value.

In a preferred embodiment, at least two coke towers are provided, and there are always at least one coke tower that is in a reaction stage and at least one coke tower that is in a decoking stage.

According to the present application, the buffer tank may be any equipment suitable for receiving the bottom oil from the pressure stabilization tower and providing a buffering action, such as a conventional oil tank, to which there is no particular limitation in the present application.

In a preferred embodiment, the system further comprises a furnace for heating the hydrocarbon-containing feedstock to be fed to the coke tower.

In a preferred embodiment, the system further comprises a hydrogenation reactor for hydrotreating a hydrocarbon-containing initial feedstock to obtain the hydrocarbon-containing feedstock to be fed to the coke tower.

In a second aspect, the present application provides a method for producing needle coke using the system of the present application, comprising the steps of:

(1) reacting a heated hydrocarbon-containing feedstock in the coke tower to obtain needle coke and an oil gas;

(2) separating the oil gas from the coke tower in the pressure stabilization tower to obtain an overhead light fraction and a bottom oil;

(3) sending the bottom oil from the pressure stabilization tower to the buffer tank, and withdrawing two streams of bottom oil from the buffer tank;

(4) returning a first stream of bottom oil from the buffer tank to the pressure stabilization tower after a temperature adjustment;

(5) sending a second stream of bottom oil from the buffer tank to the coking fractionation tower, separating the stream into a light oil and a heavy oil therein, and optionally returning the heavy oil to the coke tower for further reaction, wherein the pressure at the top of the pressure stabilization tower is adjusted by the pressure controller at the top of the pressure stabilization tower, so that the pressure at the top of the coke tower is maintained at a set value.

In a preferred embodiment, prior to step (1), the method further comprises a step (0) of hydrotreating a hydrocarbon-containing initial feedstock to obtain the hydrocarbon-containing feedstock used in step (1).

According to the present application, the hydrocarbon-containing initial feedstock can be any feedstock that is suitable for the production of needle coke after hydrotreatment, to which there is no particular limitation in the present application. For example, the hydrocarbon-containing initial feedstock may be selected from the group consisting of catalytic cracking slurry oils, catalytic cracking decant oils, ethylene tars, thermal cracking residues, coal tars, coal tar pitches, and any combination thereof, preferably catalytic cracking slurry oils.

In a further preferred embodiment, prior to the hydrotreatment step (0), the method further comprises a step of subjecting the hydrocarbon-containing initial feedstock to a solid removal treatment. The solid removal treatment may be carried out by any suitable means, which may, for example, be selected from the group consisting of filtration, centrifugal sedimentation, vacuum distillation, solvent extraction and any combination thereof.

According to the present application, the hydrotreating step (0) may be carried out using a hydrogenation reactor commonly used in the art, to which there is no particular limitation in the present application. For example, the hydrogenation reactor may be selected from the group consisting of fixed bed hydrogenation reactors, ebullated bed hydrogenation reactors, suspended bed hydrogenation reactors, moving bed hydrogenation reactors, and any combination thereof, preferably a fixed bed hydrogenation reactor.

According to the present application, the hydrotreating step (0) may be carried out using any hydrogenation catalyst commonly used in the art, to which there is no particular limitation in the present application. For example, the hydrogenation catalyst may be an existing heavy oil hydrotreating catalyst, of which the carrier is typically an inorganic oxide such as alumina, and the active component is an oxide of a metal of Group VIB and/or Group VIII, such as oxides of Mo, W, Co, Ni and the like. The hydrogenation catalyst may also be existing commercially available catalysts, such as the FZC series hydrogenation catalysts developed by Fushun Research Institute of Petroleum and Petrochemicals.

In a further preferred embodiment, the reaction conditions of the hydrotreating step (0) include: a reaction temperature of about 300-480° C., preferably about 330-400° C., a reaction pressure of about 3-20 MPa, preferably about 5-10 MPa, a hydrogen-to-oil volume ratio of about 100-2500, preferably about 500-1500, and a liquid hourly space velocity of about 0.1-2.0 preferably about 0.5-1.0 $h^{-1}$.

In a preferred embodiment, the temperature of the heated hydrocarbon-containing feedstock of step (1) (i.e., the outlet temperature of the furnace) is from about 400° C. to about 550° C., preferably from about 440° C. to about 520° C., and the temperature raising rate of the hydrocarbon-containing feedstock (i.e., the heating rate of the furnace) is from about 1° C./h to about 50° C./h, preferably from about 2° C./h to about 10° C./h; the pressure at the top of the coke tower is about 0.01-2.5 MPa, preferably about 0.2-1.5 MPa, and the coke tower can be operated at constant pressure or variable pressure, and if operated at a variable pressure, the change rate of the pressure is about 0.1-5 MPa/h; the reaction period is about 10 h to about 50 h, preferably about 30 h to about 50 h.

In a preferred embodiment, the overhead light fraction of the pressure stabilization tower in step (2) comprises non-condensable gas and distillate oil, the 95% distillate temperature of the distillate oil is controlled to be in a range of from about 150° C. to about 430° C., preferably from about 230° C. to about 370° C., and more preferably from about 230° C. to about 330° C. The 95% distillate temperature of the distillate oil in the overhead light fraction of the pressure stabilization tower may be a fixed value or fluctuate within a certain range.

In a preferred embodiment, the liquid level of the pressure stabilization tower in step (2) is controlled to be about 10% to about 80% of the total height of the tower.

In a preferred embodiment, the first stream of bottom oil in step (4) is returned to the middle of the pressure stabilization tower after being subjected to a temperature adjustment, e.g., heat exchanged with a heat exchange medium (typically a cooling medium). Preferably, the mass ratio of the first stream of bottom oil to the feed of the coke tower is from about 0.001 to about 1, preferably from about 0.05 to about 0.4; and/or the temperature at which the first stream of bottom oil is returned to the pressure stabilization tower is controlled to be about 200-380° C., preferably about 230-340° C.

In a preferred embodiment, the heat exchange medium may be cold oil, such as the hydrocarbon-containing initial feedstock, and the temperature at which the first stream of bottom oil is returned to the pressure stabilization tower is controlled by adjusting the flow rate of the heat exchange medium. For example, when a cooling medium is used, increasing the flow rate of the cooling medium can lower the temperature at which the first stream of bottom oil is returned to the pressure stabilization tower, and conversely, decreasing the flow rate of the cooling medium can raise the temperature at which the first stream of bottom oil is returned to the pressure stabilization tower.

In a preferred embodiment, the 95% distillate temperature of the distillate oil in the overhead light fraction of the pressure stabilization tower is regulated by adjusting the temperature at which the first stream of bottom oil is returned to the pressure stabilization tower. Specifically, when the 95% distillate temperature of the distillate oil is increased to 310° C. or higher, the temperature at which the first stream of bottom oil is returned to the pressure stabilization tower is lowered (for example, by increasing the flow rate of the cooling medium), so that the temperature of the evaporation section of the pressure stabilization tower is reduced, and in turn the 95% distillate temperature of the distillate oil is reduced; when the 95% distillate temperature of the distillate oil is reduced to 240° C. or lower, the temperature at which the first stream of bottom oil is returned to the pressure stabilization tower is raised (for example, by reducing the flow of the cooling medium), so that the temperature of the evaporation section of the pressure stabilization tower is increased, and in turn the 95% distillate temperature of the distillate oil is increased.

In a preferred embodiment, the liquid level of the pressure stabilization tower is regulated by adjusting the discharge rate of the bottom oil from the pressure stabilization tower and/or the recycle rate of the first stream of bottom oil. Specifically, when the liquid level of the pressure stabilization tower is increased to 60% or more of the total height of the tower, the discharge rate of the bottom oil from the pressure stabilization tower is raised, and/or the recycle rate of the first stream of bottom oil is lowered, so as to decrease the liquid level of the pressure stabilization tower; when the liquid level of the pressure stabilization tower is reduced to 20% or less of the total height of the tower, the discharge rate of the bottom oil from the pressure stabilization tower is lowered, and/or the recycle rate of the first stream of bottom oil is raised, so as to increase the liquid level of the pressure stabilization tower.

In a further preferred embodiment, the temperature and flow rate at which the first stream of bottom oil is returned to the pressure stabilization tower are controlled to simultaneously regulate the 95% distillate temperature of the distillate oil in the overhead light fraction and the liquid level of the pressure stabilization tower.

In a particularly preferred embodiment, when the liquid level of the pressure stabilization tower is increased to 60% or more of the total height of the tower and the 95% distillate temperature of the distillate oil is increased to 310° C. or higher, the temperature at which the first stream of bottom oil is returned to the pressure stabilization tower is lowered and the discharge rate of bottom oil from the pressure stabilization tower is raised; when the liquid level at the bottom of the pressure stabilization tower is increased to 60% or more of the total height of the tower and the 95% distillate temperature of the distillate oil is decreased to 240° C. or lower, the temperature at which the first stream of bottom oil is returned to the pressure stabilization tower and the discharge rate of the bottom oil from the pressure stabilization tower are raised; when the liquid level at the bottom of the pressure stabilization tower is decreased to 20% or less of the total height of the tower and the 95% distillate temperature of the distillate oil is increased to 310° C. or higher, the temperature at which the first stream of bottom oil is returned to the pressure stabilization tower and the discharge rate of the bottom oil from the pressure stabilization tower are lowered; or when the liquid level at the bottom of the pressure stabilization tower is decreased to 20% or less of the total height of the tower and the 95% distillate temperature of the distillate oil is decreased to 240° C. or lower, the temperature at which the first stream of bottom oil is returned to the pressure stabilization tower is raised, and the discharge rate of the bottom oil from the pressure stabilization tower is lowered.

In a preferred embodiment, the liquid level of the buffer tank is controlled at about 30-70% of the total height of the tank in step (3).

In a preferred embodiment, the flow rate of the second stream of bottom oil in step (5) is controlled according to the liquid level of the buffer tank. Particularly, the flow rate of the second stream of bottom oil is lowered when the liquid level of the buffer tank is lower than 25%, and the flow rate of the second stream of bottom oil is raised when the liquid level of the buffer tank is higher than 60%.

In a preferred embodiment, the temperature at which the second stream of bottom oil enters the coking fractionation tower in step (5) is controlled to be from about 370° C. to about 450° C., preferably from about 385° C. to about 420° C.

In a further preferred embodiment, the temperature at which the second bottom oil enters the coking fractionation tower in step (5) can be regulated by heat exchange with the oil gas obtained in step (1), heating with a furnace, or a combination thereof.

In a preferred embodiment, the 95% distillate temperature of the light oil separated by the coking fractionation tower in step (5) is controlled to be in a range of about 300° C. to about 400° C., preferably in a range of about 320° C. to about 360° C.

In a preferred embodiment, the light oil separated from the coking fractionation tower in step (5) may be partially recycled to the pressure stabilization tower to regulate the pressure at the top of the pressure stabilization tower and the pressure at the top of the coke tower to maintain them at the set value.

In a preferred embodiment, the heavy oil separated by the coking fractionation tower in step (5) has a 5% distillate temperature that is at least about 3° C. higher than the 95% distillate temperature of the light oil.

In a preferred embodiment, the heavy oil separated by the coking fractionator in step (5) may be directly recycled to the coke tower, or may be subjected to a solid removal treatment and then recycled to the coke tower, preferably the latter. The solid removal treatment may be carried out by any suitable means, which may, for example, be selected from the group consisting of filtration, centrifugal sedimentation or any combination thereof, preferably filtration.

In a third aspect, the present application provides a method for improving the stability of a needle coke production process, comprising the steps of:

i) producing needle coke using a system for producing needle coke according to the first aspect of the present application;

ii) adjusting the pressure at the top of the coke tower to maintain it at a set value, by regulating the pressure controller provided at the top of the pressure stabilization tower;

iii) adjusting the 95% distillate temperature of distillate oil in the overhead light fraction of the pressure stabilization tower to maintain it at a set value, by regulating the temperature at which the first stream of bottom oil returned to the pressure stabilization tower; and iv) adjusting the liquid level of the pressure stabilization tower to maintain it at a set value, by regulating the discharge rate of the bottom oil from the pressure stabilization tower and/or the recycle rate of the first stream of bottom oil.

In a preferred embodiment, the step i) is carried out according to the method for producing needle coke according to the second aspect of the present application, the specific operation of which is omitted herein.

In a preferred embodiment, the step ii) is carried out by regulating the discharge rate of the light fraction from the top of the pressure stabilization tower, for example by adjusting the opening of a valve on the light fraction discharge pipeline.

In a preferred embodiment, the step iii) is carried out in the following manner: when the 95% distillate temperature of the distillate oil is increased to 310° C. or higher, lowering the temperature at which the first stream of bottom oil is returned to the pressure stabilization tower (for example, by increasing the flow rate of a cooling medium), thereby reducing the 95% distillate temperature of the distillate oil; when the 95% distillate temperature of the distillate oil is decreased to 240° C. or lower, raising the temperature at which the first stream of bottom oil is returned to the pressure stabilization tower (for example, by reducing the flow rate of the cooling medium), thereby increasing the 95% distillate temperature of the distillate oil.

In a preferred embodiment, the step iv) is carried out in the following manner: when the liquid level of the pressure stabilization tower is increased to 60% or more of the total height of the tower, raising the discharge rate of the bottom oil from the pressure stabilization tower and/or lowering the recycle rate of the first stream of bottom oil, thereby reducing the liquid level of the pressure stabilization tower; when the liquid level of the pressure stabilization tower is decreased to 20% or less of the total height of the tower, lowering the discharge rate of the bottom oil from the pressure stabilization tower and/or raising the recycle rate of the first stream of bottom oil, thereby increasing the liquid level of the pressure stabilization tower.

As shown in FIG. 1, in a preferred embodiment, the system for producing needle coke of the present application comprises a hydrogenation reactor 2, a furnace 4, coke towers 6A/B, a pressure stabilization tower 8, a buffer tank 11, a coking fractionation tower 14, a filter 17, a heat exchanger 19, and a furnace 20. Coke towers 6A/B are provided with a feedstock inlet and an oil gas outlet; the pressure stabilization tower 8 is provided with an oil gas inlet, an overhead light fraction outlet, a bottom oil outlet and a cycle oil inlet, and a pressure controller 23 is provided at the top of the pressure stabilization tower (for example, on an overhead light fraction discharge pipeline 9) for regulating the pressure at the top thereof; the buffer tank 11 is provided with an inlet, a first bottom oil outlet and a second bottom oil outlet; and the coking fractionation tower 14 is provided with an inlet, a light oil outlet and a heavy oil outlet. The oil gas outlet of the coke towers 6A/B is in communication with the oil gas inlet of the pressure stabilization tower 8 through a pipeline 7, and no pressure controller for adjusting the pressure at the top of the coke towers 6A/B is provided in the coke tower or on the oil gas pipeline 7 connecting the coke tower to the pressure stabilization tower. The bottom oil outlet of the pressure stabilization tower is in communication with the inlet of the buffer tank 11 through a pipeline 10, the first bottom oil outlet of the buffer tank 11 is in communication with the cycle oil inlet of the pressure stabilization tower 8 through a pipeline 13, a temperature adjuster (such as a heat exchanger 19) is provided on the pipeline 13, and the second bottom oil outlet of the buffer tank is in communication with the inlet of the coking fractionation tower 14 through pipelines 12 and 21, and the heavy oil outlet of the coking fractionation tower 14 is in communication with the feedstock inlet of the coke towers 6A/B through pipelines 16, 18 and 5.

In a preferred embodiment of the method for producing needle coke of the present application, as shown in FIG. 1, a hydrocarbon-containing initial feedstock 1 having been subjected to a solid removal treatment is mixed with hydrogen gas 22 and then fed to a hydrogenation reactor 2, where the mixture is contacted with a hydrogenation catalyst for reaction, and the resulting refined oil is fed via a pipeline 3 to a delayed coking furnace 4, heated therein to a certain temperature, and fed via a pipeline 5 to the coke towers 6A/B. Coke produced in the coke towers 6A/B deposits on the bottom of the towers and the oil gas produced is passed to the pressure stabilization tower 8 through a pipeline 7. Light fraction separated by the pressure stabilization tower 8 is discharged from the top of the tower through a pipeline 9, and the bottom oil is sent to the buffer tank 11 through a pipeline 10. The bottom oil in the buffer tank 11 is discharged in two streams, one stream is sent to the heat exchanger 19, and after heat exchange therein, the stream is recycled to the pressure stabilization tower 8 through a pipeline 13, and contacted with the coking oil gas from a pipeline 7 in the pressure stabilization tower to conduct mass transfer and heat transfer; the other stream is sent via a pipeline 12 to the furnace 20, where it is heated to a certain temperature and then sent via a pipeline 21 to a coking fractionation tower 14. The second stream of bottom oil is separated in the coking fractionation tower 14 to produce a light oil and a heavy oil, wherein the light oil is discharged through a pipeline 15, and the heavy oil is sent to the filter 17 through a pipeline 16, to remove solid particles such as coke breeze therein, and then mixed with the refined oil from the pipeline 3 through a pipeline 18, and sent to the furnace 4. The pressure at the top of the pressure stabilization tower is regulated by the pressure controller 23 at the top thereof, so that the pressure at the top of the coke tower is maintained at a set value.

In some preferred embodiments, the present application provides the following technical solutions:

1. A method for improving the stability of a needle coke production process, comprising the steps of:
   (1) feeding a coking oil gas product from a coking reaction system into a pressure stabilization tower for treatment to obtain an overhead light fraction and a bottom oil;
   (2) passing the bottom oil obtained in step (1) to a buffer tank, and dividing it into two streams after a buffer treatment, wherein the first stream of bottom oil is subjected to a temperature adjustment and then recycled to the pressure stabilization tower, and the second stream of bottom oil is sent to a coking fractionation system, and separated into a light oil and a heavy oil.

2. The method for improving the stability of a needle coke production process according to Item 1, characterized in that: a pressure control system is provided at the top of the pressure stabilization tower in step (1), wherein the pressure at the top of the pressure stabilization tower is correlated to the pressure at the top of the coke tower, namely the pressure at the top of the coke tower is controlled by regulating the pressure at the top of the pressure stabilization tower.

3. The method for improving the stability of a needle coke production process according to Item 1, characterized in that: in step (1), the overhead light fraction of the pressure stabilization tower comprises non-condensable gas and distillate oil, and the 95% distillate temperature of the distillate oil is 150-430° C., preferably 230-370° C., and further preferably 230-330° C.

4. The method for improving the stability of a needle coke production process according to Item 1, characterized in that: a part of the light oil separated by the coking fractionation system in step (2) is recycled to the pressure stabilization tower so as to maintain the pressure at the top of the pressure stabilization tower and the pressure at the top of the coke tower at a set value.

5. The method for improving the stability of a needle coke production process according to Item 1, characterized in that: the heavy oil separated by the coking fractionation system in step (2) is directly recycled to the coking reaction system, or recycled to the coking reaction system after a solid removal treatment, preferably recycled after a solid removal treatment.

6. The method for improving the stability of a needle coke production process according to Item 5, characterized in that: the solid removal treatment is performed by filtration and/or centrifugal sedimentation.

7. The method for improving the stability of a needle coke production process according to Item 1, characterized in that: the liquid level of the pressure stabilization tower is 10-80% of the total height of the tower.

8. The method for improving the stability of a needle coke production process according to Item 1, characterized in that: the first stream of bottom oil in step (2) is returned to the middle of the pressure stabilization tower after being heated or cooled, wherein the mass ratio of the first stream of bottom oil to the feed of the coke tower is 0.001-1, and preferably 0.05-0.4.

9. The method for improving the stability of a needle coke production process according to Item 1, characterized in that: the operation mode of returning the bottom oil of the pressure stabilization tower to the pressure stabilization tower is determined according to the 95% distillate temperature of distillate oil in the overhead light fraction of the pressure stabilization tower and the liquid level at the bottom of the pressure stabilization tower.

10. The method for improving the stability of a needle coke production process according to Item 1, characterized in that: when the liquid level at the bottom of the pressure stabilization tower is increased to 60% or more of the total height of the tower and the 95% distillate temperature of the distillate oil is increased to 310° C. or higher, the first stream of bottom oil is returned to the pressure stabilization tower after being cooled, and the discharge rate of the bottom oil from the pressure stabilization tower is raised; when the liquid level at the bottom of the pressure stabilization tower is increased to 60% or more of the total height of the tower and the 95% distillate temperature of the distillate oil is decreased to 240° C. or lower, the first stream of bottom oil is returned to the pressure stabilization tower after being heated, and the discharge rate of the bottom oil from the pressure stabilization tower is raised; when the liquid level at the bottom of the pressure stabilization tower is decreased to 20% or less of the total height of the tower and the 95% distillate temperature of the distillate oil is increased to 310° C. or higher, the first stream of bottom oil is returned to the pressure stabilization tower after being cooled, and the discharge rate of the bottom oil from the pressure stabilization tower is lowered; when the liquid level at the bottom of the pressure stabilization tower is decreased to 20% or less of the total height of the tower and the 95% distillate temperature of the distillate oil is decreased to 240° C. or lower, the first stream of bottom oil is returned to the pressure stabilization tower after being heated, and the discharge rate of the bottom oil from the pressure stabilization tower is lowered.

11. The method for improving the stability of a needle coke production process according to Item 1, characterized in that: the liquid level of the buffer tank is controlled to be 30-70% of the total height of the tank.

12. The method for improving the stability of a needle coke production process according to Item 1, characterized in that: the flow rate of the second stream of bottom oil in step (4) is controlled according to the liquid level of the buffer tank, and the flow rate of the second stream of bottom oil is lowered when the liquid level of the buffer tank is lower than 25%, and the flow rate of the second stream of bottom oil is raised when the liquid level is higher than 60%.

13. A system for improving the stability of a needle coke production process, comprising:

a coking reaction system for receiving and processing a feedstock;

a pressure stabilization tower for receiving a reaction product from the coking reaction system and separating it into an overhead light fraction and a bottom oil;

a buffer tank for receiving a bottom oil from the pressure stabilization tower, and splitting it into two streams, namely a first stream of bottom oil and a second stream of bottom oil, after a treatment, wherein the first stream of bottom oil is returned to the pressure stabilization tower through a pipeline, on which a temperature adjuster is provided;

a coking fractionation tower for receiving the second stream of bottom oil from the buffer tank and separating it into a light oil and a heavy oil.

14. The system for improving the stability of a needle coke production process according to Item 13, characterized in that: the operating pressure of the pressure stabilization tower is correlated to the operating pressure of the coke tower, a pressure control system is provided at the top of the pressure stabilization tower, and pressure control is carried out by means of the flow rate of the overhead light fraction of the pressure stabilization tower, so that the pressure at the top of the coke tower is maintained at a set value.

15. The system for improving the stability of a needle coke production process of Item 13, characterized in that: the coking reaction system comprises at least one furnace and two coke towers, wherein there is always at least one coke tower that is in a reaction stage, and at least one coke tower that is in a decoking stage.

16. A process for producing needle coke, comprising the steps of:

(1) mixing a needle coke feedstock and hydrogen, feeding the mixture into a hydrogenation reaction zone to contact with a hydrogenation catalyst, and separating the resulting reaction effluent to obtain gas, naphtha and a refined oil;

(2) feeding the refined oil obtained in step (1) into a delayed coking reaction system for reaction, passing the resulting oil gas product into a pressure stabilization tower, and separating it to obtain an overhead light fraction and a bottom oil;

(3) passing the bottom oil obtained in step (2) into a buffer tank, and splitting it into two streams, namely a first stream of bottom oil and a second stream of bottom oil, wherein the first stream of bottom oil is returned to the pressure stabilization tower after a temperature adjustment;

(4) passing the second stream of bottom oil obtained in step (3) into a coking fractionation system, and separating it to obtain a light oil and a heavy oil.

17. The method for producing needle coke according to Item 16, characterized in that: the needle coke feedstock in step (1) is one or more selected from catalytic cracking slurry oils, catalytic cracking decant oils, ethylene tars, thermal cracking residues, coal tars, and coal tar pitches, preferably catalytic cracking slurry oils.

18. The method for producing needle coke according to Item 16, characterized in that: in step (1), the needle coke feedstock is firstly subjected to a solid removal treatment, wherein the solid removal treatment is one of filtration, centrifugal sedimentation, vacuum distillation and solvent extraction, or a combination of two or more thereof.

19. The method for producing needle coke according to Item 16, characterized in that: the operating conditions of the hydrogenation reaction zone in step (1) include: a reaction temperature of 300-480° C., preferably 330-400° C., a reaction pressure of 3-20 MPa, preferably 5-10 MPa, a hydrogen-to-oil volume ratio of 100-2500, preferably 500-1500, and a liquid hourly space velocity of 0.1-2.0 $h^{-1}$, preferably 0.5-1.0 $h^{-1}$.

20. The method for producing needle coke according to Item 16, characterized in that: the delayed coking reaction system in step (2) comprises at least one furnace and two coke towers, wherein there is always at least one coke tower that is in a reaction stage, and at least one coke tower that is in a decoking stage; the outlet temperature of the furnace is 400-550° C., preferably 440-520° C., and the heating rate is 1-50° C./h, preferably 2-10° C./h; the pressure at the top of the coke tower is 0.01-2.5 MPa, preferably 0.2-1.5 MPa, and the reaction period is 10-50 h, preferably 30-50 h.

21. The method for producing needle coke according to Item 16, characterized in that: a pressure control system is provided at the top of the pressure stabilization tower in step (2), wherein the pressure at the top of the pressure stabilization tower is correlated to the pressure at the top of the coke tower, namely the pressure at the top of the coke tower is controlled by regulating the pressure at the top of the pressure stabilization tower.

22. The method for producing needle coke according to Item 16, characterized in that: in step (2), the overhead light fraction of the pressure stabilization tower comprise non-condensable gas and distillate oil, and the 95% distillate temperature of the distillate oil is 150-430° C., preferably 230-370° C., and further preferably 230-330° C.

23. The method for producing needle coke according to Item 16, characterized in that: the liquid level of the pressure stabilization tower in step (2) is 10-80% of the total height of the tower.

24. The method for producing needle coke according to Item 6, characterized in that: the first stream of bottom oil in step (3) is returned to the middle of the pressure stabilization tower after being heated or cooled; the mass ratio of the first stream of bottom oil to the feed of the coke tower is 0.001-1, preferably 0.05-0.4.

25. The method for producing needle coke according to Item 16, characterized in that: the operation mode of returning the bottom oil of the pressure stabilization tower to the pressure stabilization tower is determined according to the 95% distillate temperature of the distillate oil in the overhead light fraction of the pressure stabilization tower and the liquid level at the bottom of the pressure stabilization tower.

26. The method for producing needle coke according to Item 25, characterized in that: when the liquid level at the bottom of the pressure stabilization tower is increased to 60% or more of the total height of the tower and the 95% distillate temperature of the distillate oil is increased to 310° C. or higher, the first stream of bottom oil is returned to the pressure stabilization tower after being cooled, and the discharge rate of the bottom oil from the pressure stabilization tower is raised; when the liquid level at the bottom of the pressure stabilization tower is increased to 60% or more of the total height of the tower and the 95% distillate temperature of the distillate oil is decreased to 240° C. or lower, the first stream of bottom oil is returned to the pressure stabilization tower after being heated, and the discharge rate of the bottom oil from the pressure stabilization tower is raised; when the liquid level at the bottom of the pressure stabilization tower is decreased to 20% or less of the total height of the tower and the 95% distillate temperature of the distillate oil is increased to 310° C. or higher, the first stream of bottom oil is returned to the pressure stabilization tower after being cooled, and the discharge rate of the bottom oil from the pressure stabilization tower is lowered; when the liquid level at the bottom of the pressure stabilization tower is decreased to 20% or less of the total height of the tower and the 95% distillate temperature of the distillate oil is decreased to 240° C. or lower, the first stream of bottom oil is returned to the pressure stabilization tower after being heated, and the discharge rate of the bottom oil from the pressure stabilization tower is lowered.

27. The method for producing needle coke according to Item 16, characterized in that: the liquid level of the buffer tank in step (3) is controlled to be 30-70% of the total height of the tank.

28. The method for producing needle coke according to Item 16, characterized in that: the flow rate of the second stream of bottom oil is controlled according to the liquid level of the buffer tank, and the flow rate of the second stream of bottom oil is lowered when the liquid level of the buffer tank is lower than 25%, and the flow rate of the second stream of bottom oil is raised when the liquid level is higher than 60%.

29. The method for producing needle coke according to Item 16, characterized in that: the light oil separated by the coking fractionation system in step (4) has a 95% distillate temperature of 300-400° C., and preferably 320-360° C.

30. The method for producing needle coke according to Item 16, characterized in that: a part of the light oil separated by the coking fractionation system is recycled to the pressure stabilization tower to maintain the pressure at the top of the pressure stabilization tower and the pressure at the top of the coke tower at a set value.

31. The method for producing needle coke according to Item 16, characterized in that: the 5% distillate temperature of the heavy oil separated by the coking fractionation system in step (4) is at least 3° C. higher than the 95% distillate temperature of the light oil.

32. The method for producing needle coke according to Item 16, characterized in that: the heavy oil separated by the coking fractionation system in step (4) is directly recycled to the coking reaction system, or recycled to the coking reaction system after a solid removal treatment.

EXAMPLES

The present application will be further illustrated with reference to the following examples, but the present application is not limited thereto.

The hydrocarbon-containing initial feedstock used in the following examples and comparative examples was a catalytic cracking slurry oil that had been subjected to a solid removal treatment, the properties of which are shown in Table 1.

TABLE 1

Properties of the catalytic cracking slurry oil after a solid removal treatment

| Item | Catalytic cracking slurry oil |
|---|---|
| Sulfur content, wt. % | 0.83 |
| Ash content, wt. % | 0.007 |
| 5% distillate temperature/° C. | 345 |
| 95% distillate temperature/° C. | 526 |

Example 1

Figure 2:
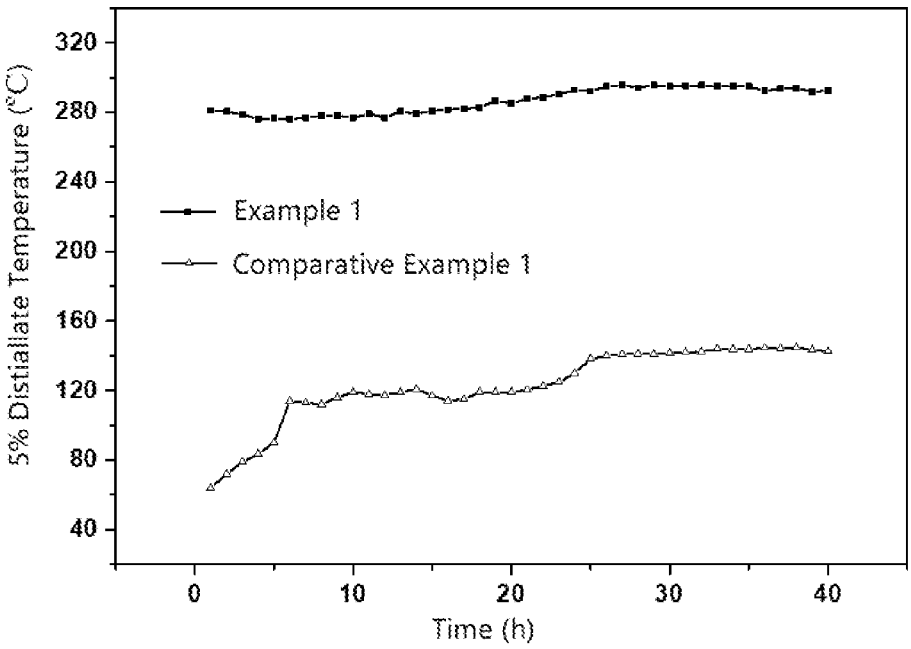
FIG. 2 shows a plot of 5% distillate temperature of the liquid component in the feed to the coking fractionation tower as a function of reaction time.
Figure 3:
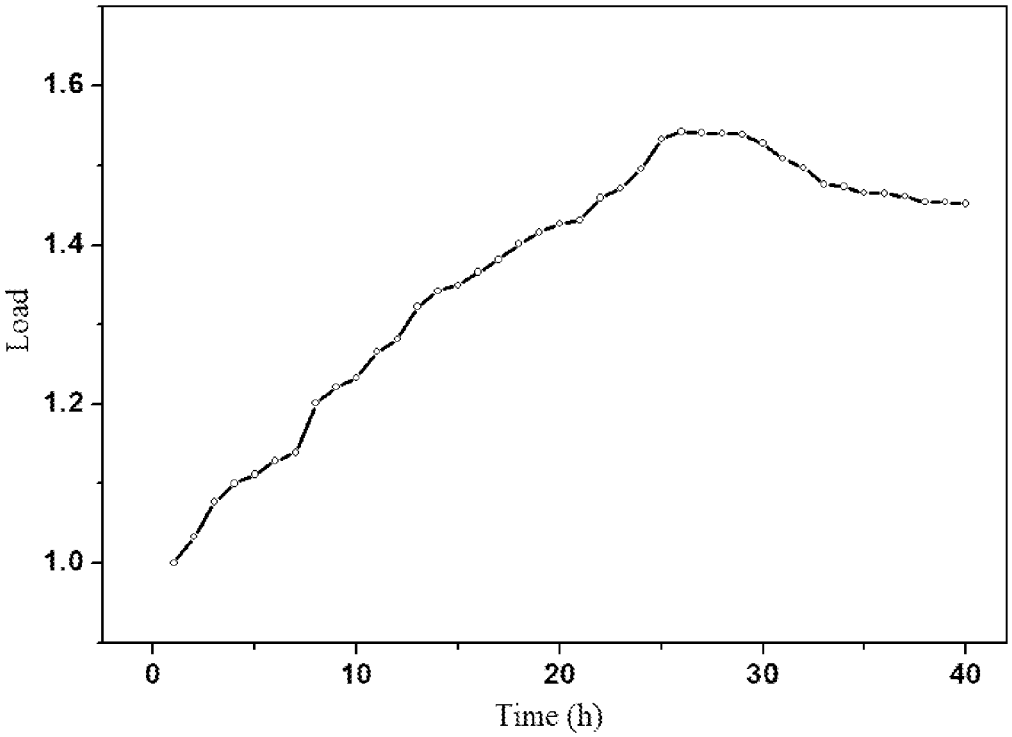
FIG. 3 shows a plot of the load of the coking fractionation tower as a function of reaction time for Example 1.

An experiment was carried out in accordance with the process flow shown in FIG. 1, in which a catalytic cracking slurry oil had been subjected to a solid removal treatment was mixed with hydrogen and fed into a hydrogenation reactor. A hydrogenation catalyst with a trade name of FZC-34 (commercially available, developed by Fushun Research Institute of Petroleum and Petrochemicals) was used, and the hydrogenation conditions included: a reaction temperature of 385° C., a reaction pressure of 8 MPa, a hydrogen-to-oil volume ratio of 1000, and a liquid hourly space velocity of 0.8 $h^{-1}$. The resulting hydrofined oil was sent to a delayed coking reaction unit (comprising a furnace and a coke tower), the outlet temperature of the furnace was 450-510° C., the coke tower was operated at a variable pressure, the initial pressure at the top of the tower was 1.2 MPa, when the feeding time reached 60% of the reaction period, the pressure at the top of the tower was reduced to 0.2 MPa at a rate of 0.5 MPa/h, and the reaction period was 40 h; the coking oil gas generated by the reaction was sent to a pressure stabilization tower, a light fraction was discharged from the top of the pressure stabilization tower, in which the distillate oil had a 95% distillate temperature of 248° C., and a bottom oil was discharged from the bottom of the tower to a buffer tank. The bottom oil withdrawn from the buffer tank was split into two streams, the first stream was adjusted to a temperature of 267° C. and then recycled to the middle of the pressure stabilization tower, and the second stream was sent to a coking fractionation tower, and separated therein into a light oil and a heavy oil, wherein the light oil had a 95% distillate temperature of 345° C., the heavy oil had a 5% distillation temperature of 352° C., and the heavy oil was returned to the delayed coking reaction unit after being filtered for solid removal. The 5% distillate temperature of the feed to the coking fractionation tower was plotted as a function of reaction time as shown in FIG. 2. The load of the coking fractionation tower over the reaction period is shown in FIG. 3.

Example 2

Figure 4:
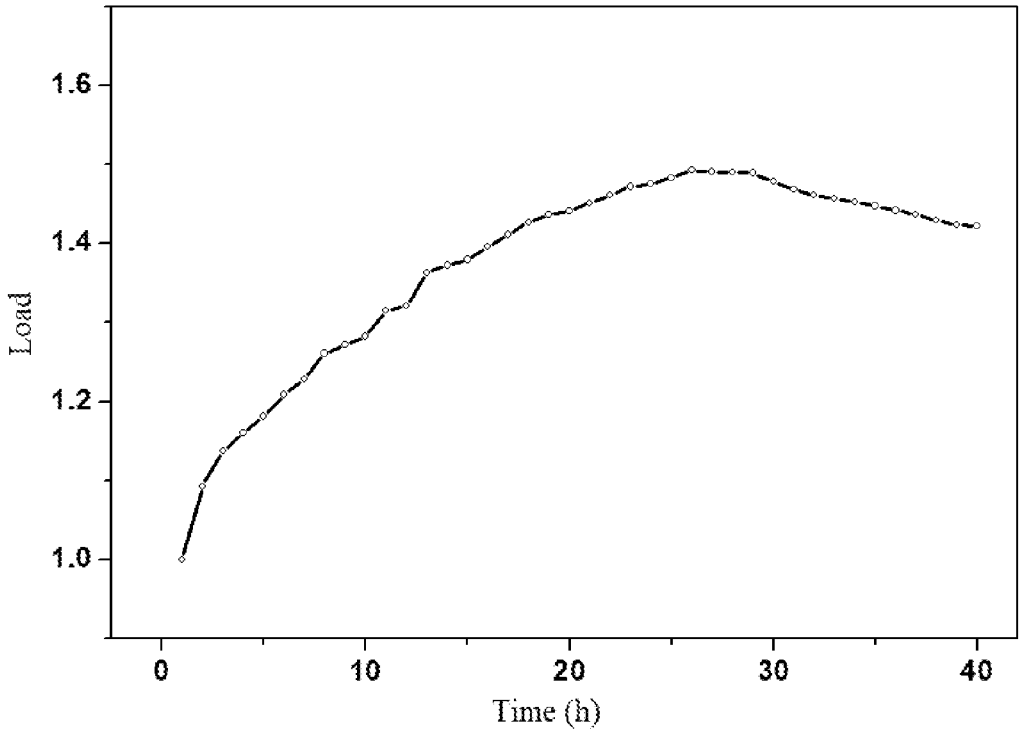
FIG. 4 shows a plot of the load of the coking fractionation tower as a function of reaction time for Example 2.

An experiment was carried out as described in Example 1, except that the coke tower was operated at a constant pressure of 0.8 MPa. The load of the coking fractionation tower over the reaction period is shown in FIG. 4.

Comparative Example 1

A prior art method was employed to produce needle coke, in which no pressure stabilization tower or buffer tank was provided, and the oil gas generated by coking reaction was directly sent to a coking fractionation tower. The catalytic cracking slurry oil had been subjected to a solid removal treatment was mixed with hydrogen, and fed into a hydrogenation reactor. The hydrogenation catalyst with a trade name of FZC-34 was used, and the hydrogenation conditions included: a reaction temperature of 385° C., a reaction pressure of 8 MPa, a hydrogen-to-oil volume ratio of 1000, and a liquid hourly space velocity of 0.8 $h^{-1}$; the resulting hydrofined oil was sent to a delayed coking reaction unit, the outlet temperature of the furnace was 450-510° C., the coke tower was operated at a variable pressure, the initial pressure at the top of the tower was 1.0 MPa, when the feeding time reached 60% of the reaction period, the pressure at the top of the tower was reduced to 0.2 MPa at a rate of 0.4 MPa/h, and the reaction period was 40 h; the coking oil gas generated by the reaction was sent to a coking fractionation tower, and separated into a light oil and a heavy oil. The 95% distillate temperature of the light oil fluctuated between 328° C. and 347° C., the 5% distillation temperature of the heavy oil was 330-359° C., and the heavy oil was returned to the delayed coking reaction unit after being filtered for solid removal. The 5% distillate temperature of the liquid in the feed to the coking fractionation tower was plotted as a function of reaction time as shown in FIG. 2. The load of the coking fractionation tower over the reaction period was shown in FIG. 5.

Comparative Example 2

An experiment was carried out as described in Comparative Example 1, except that the coke tower was operated at a constant pressure of 0.8 MPa. The load of the coking fractionation tower over the reaction period was shown in FIG. 6.

As shown in FIG. 2, in Example 1, the fluctuation range of the 5% distillate temperature of the liquid material fed to the coking fractionation tower is about 20° C.; in Comparative Example 1, the fluctuation range of the 5% distillate temperature of the liquid material fed to the coking fractionation tower is about 81° C. The above comparison shows that the composition of the feed to the coking fractionation tower is relatively stable in Example 1, whereas the fluctuation range is larger in Comparative Example 1.

Figure 5:
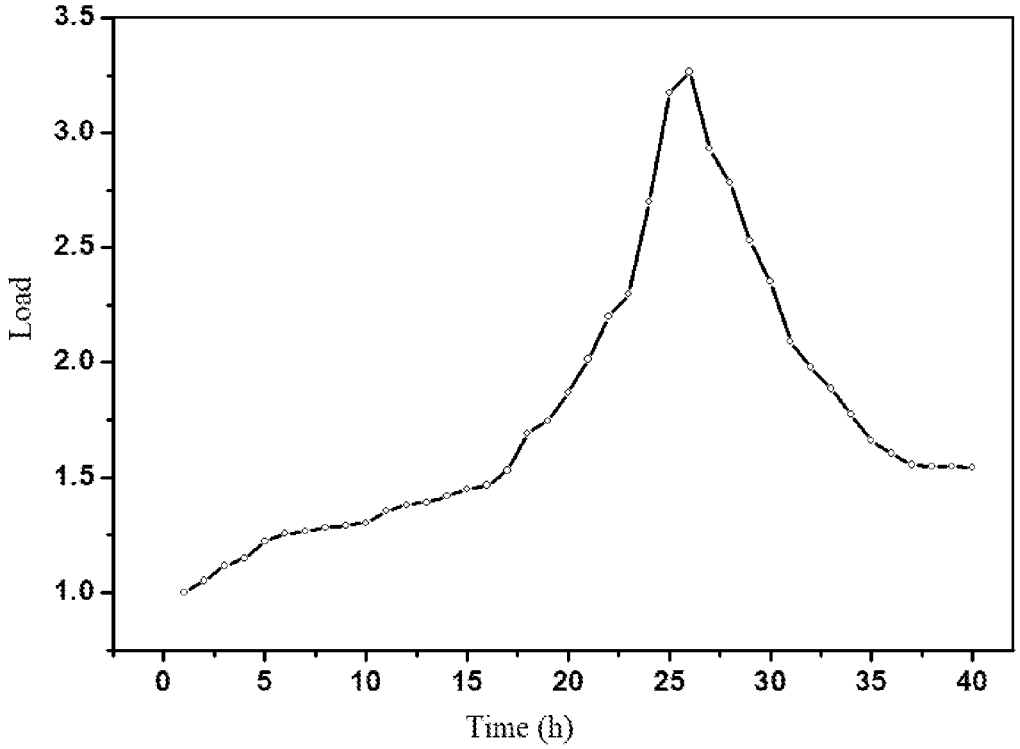
FIG. 5 shows a plot of the load of the coking fractionation tower as a function of reaction time for Comparative Example 1.
Figure 6:
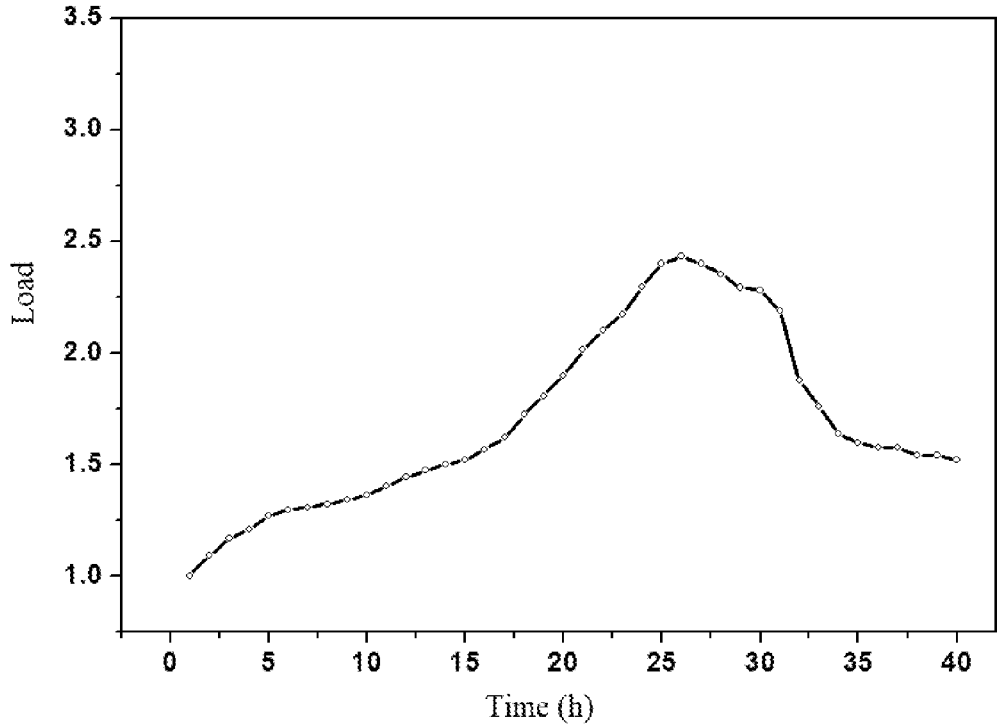
FIG. 6 shows a plot of the load of the coking fractionation tower as a function of reaction time for Comparative Example 2.

As shown in FIGS. 3-6, the feed rate of the coking fractionation tower changes as the reaction proceeds, i.e., the load of the coking fractionation tower changes continuously. As shown in FIG. 3, the coking fractionation tower of Example 1 has a peak load that is 1.6 times the starting load. As shown in FIG. 4, the coking fractionation tower of Example 2 has a peak load of 1.5 times the starting load. In contrast, as shown in FIG. 5, the coking fractionation tower of Comparative Example 1 has a peak load of 3.3 times the starting load; as shown in FIG. 6, the coking fractionation tower of Comparative Example 2 has a peak load of 2.5 times the starting load. The above comparison shows that the fluctuation in the load of the coking fractionation column of Comparative Examples 1-2 is significantly larger than that of Examples 1-2. The present application is illustrated in detail hereinabove with reference to preferred embodiments, but is not intended to be limited to those embodiments. Various modifications may be made following the inventive concept of the present application, and these modifications shall be within the scope of the present application.

It should be noted that the various technical features described in the above embodiments may be combined in any suitable manner without contradiction, and in order to avoid unnecessary repetition, various possible combinations are not described in the present application, but such combinations shall also be within the scope of the present application.

In addition, the various embodiments of the present application can be arbitrarily combined as long as the combination does not depart from the spirit of the present application, and such combined embodiments should be considered as the disclosure of the present application.

The invention claimed is:

1. A system for producing needle coke, comprising:

a coke tower provided with a feedstock inlet and an oil gas outlet, wherein a hydrocarbon-containing feedstock is reacted to produce the needle coke and an oil gas in the coke tower;

a pressure stabilization tower provided with an oil gas inlet, an overhead light fraction outlet, a bottom oil outlet and a cycle oil inlet, wherein the oil gas from the coke tower is received and separated into an overhead light fraction and a bottom oil, and a pressure controller is provided at a top of the pressure stabilization tower for adjusting the pressure at the top of the pressure stabilization tower;

a buffer tank provided with an inlet, a first bottom oil outlet, and a second bottom oil outlet, for receiving the bottom oil from the pressure stabilization tower; and a coking fractionation tower provided with an inlet, a light oil outlet and a heavy oil outlet, wherein a bottom oil from the buffer tank is received and separated into a light oil and a heavy oil;

wherein the oil gas outlet of the coke tower is in communication with the oil gas inlet of the pressure stabilization tower through a pipeline, and no pressure controller for adjusting the pressure at the top of the coke tower is provided in the coke tower or on the oil gas pipeline connecting the coke tower to the pressure stabilization tower, the inlet of the buffer tank is in communication with the bottom oil outlet of the pressure stabilization tower, the first bottom oil outlet of the buffer tank is in communication with the cycle oil inlet of the pressure stabilization tower through a pipeline with a temperature adjuster provided thereon, and the second bottom oil outlet of the buffer tank is in communication with the inlet of the coking fractionation tower, and optionally, the heavy oil outlet of the coking fractionation tower is in communication with the feedstock inlet of the coke tower.

2. The system for producing needle coke according to claim 1, wherein the pressure controller at the top of the pressure stabilization tower can be used to adjust the pressure at the top of the pressure stabilization tower by regulating the flow rate of the light fraction discharged at the top of the pressure stabilization tower, and in turn maintain the pressure at the top of the coke tower at a set value.

3. The system for producing needle coke according to claim 1, further comprising at least one additional coke towers, wherein at least one coke tower in the system is in a reaction stage and at least one coke tower in the system is in a decoking stage.

4. The system for producing needle coke according to claim 1, further comprising a furnace for heating the hydrocarbon-containing feedstock to be fed to the coke tower.

5. The system for producing needle coke according to claim 1, further comprising a hydrogenation reactor for hydrotreating a hydrocarbon-containing initial feedstock to obtain the hydrocarbon-containing feedstock to be fed to the coke tower.

6. A method for producing needle coke using the system according to claim 1, comprising the steps of:

(1) reacting a heated hydrocarbon-containing feedstock in the coke tower to obtain the needle coke and the oil gas;

(2) separating the oil gas from the coke tower in the pressure stabilization tower to obtain the overhead light fraction and the bottom oil;

(3) sending the bottom oil from the pressure stabilization tower to the buffer tank, and withdrawing a first stream of bottom oil and a second stream of bottom oil from the buffer tank;

(4) returning the first stream of bottom oil from the buffer tank to the pressure stabilization tower after a temperature adjustment;

(5) sending the second stream of bottom oil from the buffer tank to the coking fractionation tower, separating the stream into the light oil and the heavy oil therein, and optionally returning the heavy oil to the coke tower for further reaction, wherein the pressure at the top of the pressure stabilization tower is adjusted by the pressure controller at the top of the pressure stabilization tower, so that the pressure at the top of the coke tower is maintained at a set value.

7. The method according to claim 6, further comprising, prior to step (1), performing a solid removal treatment on a hydrocarbon-containing initial feedstock, wherein the solid removal treatment is selected from filtration, centrifugal sedimentation, vacuum distillation, solvent extraction, and combinations thereof; and a step of hydrotreating the hydrocarbon-containing initial feedstock to obtain the hydrocarbon-containing feedstock, wherein the hydrocarbon-containing initial feedstock is selected from the group consisting of catalytic cracking slurry oils, catalytic cracking decant oils, ethylene tars, thermal cracking residues, coal tars, coal tar pitches, and combinations thereof.

8. The method according to claim 7, wherein the hydrotreating step has a reaction temperature of about 300-480° C., a reaction pressure of about 3-20 MPa, a hydrogen-to-oil volume ratio of about 100-2500, and a liquid hourly space velocity of about 0.1-2.0 $h^{-1}$.

9. The method according to claim 7, wherein the reaction conditions of the hydrotreating step include: a reaction temperature of about 330-400° C., a reaction pressure of about 5-10 MPa, a hydrogen-to-oil volume ratio of about 500-1500, and a liquid hourly space velocity of about 0.5-1.0 $h^{-1}$.

10. The method according to claim 6, wherein the heated hydrocarbon-containing feedstock of step (1) has a temperature of about 400-550° C., and the hydrocarbon-containing feedstock is heated at a rate of about 1-50° C./h, the pressure at the top of the coke tower is about 0.01-2.5 MPa, and the reaction duration is about 10-50 h.

11. The method according to claim 6, wherein the heated hydrocarbon-containing feedstock of step (1) has a temperature of about 440-520° C., and the hydrocarbon-containing feedstock is heated at a rate of about 2-10° C./h; the pressure at the top of the coke tower is about 0.2-1.5 MPa, and the reaction duration is about 30-50 h.

12. The method according to claim 6, wherein the overhead light fraction of step (2) comprises a non-condensable gas and a distillate oil, the 95% distillate temperature of the distillate oil is controlled to be about 150-430° C., a liquid level of the pressure stabilization tower is controlled to be about 10-80% of the total height of the tower in step (2).

13. The method according to claim 12, wherein the 95% distillate temperature of the distillate oil is controlled to be about 230-370° C.

14. The method according to claim 12, wherein the 95% distillate temperature of the distillate oil is controlled to be about 230-330° C.

15. The method according to claim 12, wherein:

when the liquid level of the pressure stabilization tower is increased to 60% or more of the total height of the tower and the 95% distillate temperature of the distillate oil is increased to 310° C. or higher, the temperature at which the first stream of bottom oil is returned to the pressure stabilization tower is lowered and the discharge rate of the bottom oil from the pressure stabilization tower is raised;

when the liquid level at the bottom of the pressure stabilization tower is increased to 60% or more of the total height of the tower and the 95% distillate temperature of the distillate oil is decreased to 240° C. or lower, both the temperature at which the first stream of bottom oil is returned to the pressure stabilization tower and the discharge rate of the bottom oil from the pressure stabilization tower are raised;

when the liquid level at the bottom of the pressure stabilization tower is decreased to 20% or less of the total height of the tower and the 95% distillate temperature of the distillate oil is increased to 310° C. or higher, both the temperature at which the first stream of bottom oil is returned to the pressure stabilization tower and the discharge rate of the bottom oil from the pressure stabilization tower are lowered; or when the liquid level at the bottom of the pressure stabilization tower is decreased to 20% or less of the total height of the tower and the 95% distillate temperature of the distillate oil is decreased to 240° C. or lower, the temperature at which the first stream of bottom oil is returned to the pressure stabilization tower is raised, and the discharge rate of the bottom oil from the pressure stabilization tower is lowered.

16. The method according to claim 6, wherein the first stream of bottom oil is returned to the middle of the pressure stabilization tower after a temperature adjustment in step (4);

the mass ratio of the first stream of bottom oil to the feed of the coke tower is from about 0.001 to about 1, and/or the temperature at which the first stream of bottom oil is returned to the pressure stabilization tower is controlled to be about 200-380° C.

17. The method according to claim 16, wherein the mass ratio of the first stream of bottom oil to the feed of the coke tower is from about 0.05 to about 0.4; and/or the temperature at which the first stream of bottom oil is returned to the pressure stabilization tower is controlled to be about 230-340° C.

18. The method according to claim 6, wherein a liquid level of the buffer tank is controlled to be about 30-70% of the total height of the tank in step (3), the flow rate of the second stream of bottom oil in step (5) is controlled according to the liquid level of the buffer tank, the flow rate of the second stream of bottom oil is lowered when the liquid level of the buffer tank is lower than 25%, and the flow rate of the second stream of bottom oil is raised when the liquid level is higher than 60%.

19. The method according to claim 6, wherein the 95% distillate temperature of the light oil separated by the coking fractionation tower in step (5) is controlled to be about 300-400° C., the method further comprises a step of recycling a part of the light oil separated by the coking fractionation tower in step (5) to the pressure stabilization tower so as to regulate the pressure at the top of the pressure stabilization tower and the pressure at the top of the coke tower.

20. The method according to claim 19, wherein the 95% distillate temperature of the light oil separated by the coking fractionation tower in step (5) is controlled to be about 320-360° C.

21. The method according to claim 6, wherein the 5% distillate temperature of the heavy oil separated by the coking fractionation tower in step (5) is controlled to be at least about 3° C. higher than the 95% distillate temperature of the light oil, and the heavy oil obtained in step (5) is directly recycled to the coke tower, or recycled to the coke tower after a solid removal treatment.

* * * * *